US005725109A

United States Patent [19]

Moulton et al.

[11] Patent Number: 5,725,109

[45] Date of Patent: Mar. 10, 1998

[54] RACK FOR HOLDING TUBES AND THE LIKE IN AN UPRIGHT POSITION

[75] Inventors: Tom Moulton, San Francisco; Bob Hill, Novato, both of Calif.

[73] Assignee: LABCON, North America, San Rafael, Calif.

[21] Appl. No.: 795,239

[22] Filed: Feb. 10, 1997

Related U.S. Application Data

[63] Continuation of Ser. No. 531,098, Sep. 20, 1995, abandoned, which is a continuation of Ser. No. 154,190, Nov. 18, 1993, abandoned.

[51] Int. Cl.[6] ..... A47G 29/00

[52] U.S. Cl. ..... 211/73; 211/85

[58] Field of Search ..... 211/60.1, 70.1, 211/71, 72, 73, 85, 125; 206/446, 443

[56] References Cited

U.S. PATENT DOCUMENTS

| | | | |
|---|---|---|---|
| D. 245,118 | 7/1977 | Heaton | 597/358 |
| 1,021,998 | 4/1912 | Myers . | |
| 1,836,138 | 12/1931 | Turner | 211/74 |
| 2,568,677 | 9/1951 | Adelson | 211/72 |
| 3,062,380 | 11/1962 | Grela et al. | 211/73 |
| 3,375,934 | 4/1968 | Bates | 211/72 |
| 3,390,783 | 7/1968 | Quackenbush | 211/73 |
| 3,682,597 | 8/1972 | Husch | 23/259 |
| 3,751,172 | 8/1973 | Seitz et al. | 237/824 |
| 3,987,892 | 10/1976 | Killy | 604/420 |
| 4,349,109 | 9/1982 | Scordato et al. | 206/562 |
| 4,434,890 | 3/1984 | Sieck et al. | 331/343 |
| 5,057,282 | 10/1991 | Linder | 558/582 |

*Primary Examiner*—Ramon O. Ramirez
*Assistant Examiner*—Gwendolyn W. Baxter
*Attorney, Agent, or Firm*—Phillips, Moore, Lempio & Finley

[57] ABSTRACT

A novel rack for holding test tubes, elongated objects and the like in an upright position. The rack is formed in a one-piece construction having upper and intermediate panels, both panels having holes which are aligned with one another to receive tubes passing through both panels. The holes securely retain the tubes upright and separate from each other during shipping and dispensing by means of easily deformable holes having integral slits radiating from each hole. The carton is lightweight, collapsible and can be easily scored and recycled.

3 Claims, 4 Drawing Sheets

RACK FOR HOLDING TUBES AND THE LIKE IN AN UPRIGHT POSITION

This is a continuation of application of Ser. No. 08/531,098 filed on Sep. 20, 1995, now abandoned, which is a file wrapper continuation of application Ser. No. 08/154,190 filed on Nov. 18, 1993, now abandoned.

BACKGROUND OF THE INVENTION

This invention relates generally to specimen tube and test tube containers and more particularly to a new and improved one-piece, free-standing collapsible carton (rack) used to hold and dispense a plurality of specimen tubes, laboratory test tubes and the like, securely holding them separate and in an upright position.

It is known in the prior art to form racks for specimen tubes, test tubes and the like from folded paper, cardboard or paperboard, which incorporate upper and intermediate panels positioned within the carton or rack, the tube passing through both panels, for the purpose of maintaining the test tube or specimen tube in an upright position. These containers used various designs to maintain adequate structural rigidity for a free-standing rack. For instance, past designs would use a heavy, rigid material such as metal or plastic, or use intricate cardboard locking tab systems or require that the material be wastefully folded over on itself to achieve the required structural strength. Those racks in the prior art that were not of the free-standing variety required a surrounding carton to contain the rack in order to lend it structural integrity.

Moreover, the prior art frequently required that the rack be made from more than one part, requiring laborious assembly and disassembly which rendered them impractical for use in the high volume production and shipping of test tubes, specimen tubes or the like.

Furthermore, in most of the prior art the racks were designed only to maintain a tube in an upright position, not to securely retain the tubes in the rack. The only thing holding the tube within the rack was the weight of the tube itself. Should the rack be jostled or tipped on its side, the tubes would fall out of their holes. Attempts in the prior art were made to incorporate a retaining mechanism, but required complicated tab mechanisms or covers for the racks to retain the tubes in their holes.

Consequently, it is currently a common practice to forego altogether the use of racks made from folded paper materials which use paper products and have upper and intermediate panels, and to use, instead, racks made from polyethylene, polycarbonate plastic or styrofoam. The styrofoam racks are little more than blocks of styrofoam with bores formed in them to tightly receive the tubes. Plastic and styrofoam racks are expensive and are not biodegradable, they are difficult to recycle and cannot be collapsed to store for disposal. Styrofoam racks also require chloroflourocarbons to produce, which are thought to be harmful to the earth's protective ozone layer.

For the foregoing reasons, there is a need for a rack which can maintain tubes in an upright position, which is made from recyclable material, such as paper, using a minimal amount of material, which can be easily assembled or disassembled into a flattened condition to allow for easy storage and disposal and which incorporates a mechanism for securing the tubes within their holes.

SUMMARY OF THE INVENTION

The present invention is directed to a rack that satisfies the above need to have a sturdy rack made with a minimum of material, which is easy to collapse, recyclable and further is capable of holding tubes in an upright position and in a secure fashion.

There is provided a rack which is formed from a one piece production blank. The rack is formed from the blank by folding the various sections and panels at right angles, generally in a continuous spiral fashion.

The blank has a first side section on one end, connected on one side to a top panel. The top panel has a pattern of holes sized to receive a given type of tube. The top panel is further connected to a second side section at the side distal the first side section. Each of these side sections further has end sections which are ultimately bent inwardly to rest within the formed rack, lending it additional structural rigidity.

To form the blank into a rack, the side sections on either side of the top panel are bent to extend downwardly at right angles to the top panel. The second side section is successively connected to a bottom panel, which is bent .to lay under the top panel, forming the bottom of the rack. The bottom panel is in turn connected to a support section on the side of the bottom panel distal the second side section, which is glued by means of an adhesive to the inner side of the first side section. This support section is in turn connected on its distal side to an intermediate panel having an identical pattern of holes to the top panel. This support section supports one end of the intermediate panel. This intermediate panel is bent at a right angle inwardly to the structure, resulting in an alignment of the holes of the top and intermediate panels. This allows a tube to be passed through a hole in the top panel and then through its complementary hole in the intermediate panel, thereby holding the tube in an upright position. Finally, the bottom panel is connected to a second support section which is glued by means of an adhesive to the inner side of the second side section, supporting the other end of the intermediate panel.

Two rectangular flaps, attached to the remaining sides of the top panel, each having a flange, are folded inwardly into the structure to prevent the rack from collapsing; this completes the rack.

In order to prevent the tubes from slipping out of the rack, slits radiating from the each hole are provided. When a tube of slightly greater diameter than the hole is placed within that hole a slight deformation of the hole occurs, thereby holding the tube securely in the hole by the friction created between the edge of the hole and the tube.

In order to increase the rack's capacity to carry tubes, the rows of holes formed on the top and intermediate panels may be staggered, allowing the rows to be placed more closely together.

A view port is a further improvement and is made by forming a hole in each of the flaps, allowing the user to see within the rack and view the contents of any transparent tubes placed in the vicinity of that view port.

Accordingly, it is an object and advantage of the invention to provide a new and novel, lightweight, one-piece rack which can maintain tubes and other elongated objects in an upright position by means of top and intermediate panels formed integrally within the rack and further by use of a minimal amount of inexpensive material in the making of that rack.

It is another object of the invention to provide a one-piece rack which can maintain tubes and other elongated objects in an upright position and can be easily assembled and collapsed to allow for storage and recycling.

It is yet another object of the invention to provide a one-piece rack which can maintain tubes and other elongated objects in an upright position that can be made of recyclable materials and help avoid the use of styrofoam and other materials which require the use of chloroflourocarbons.

These and other features, aspects and advantages of the present invention will become better understood with regard to the following description, appended claims and accompanying drawings detailing the preferred embodiment.

DESCRIPTION OF THE INVENTION

Figure 1:
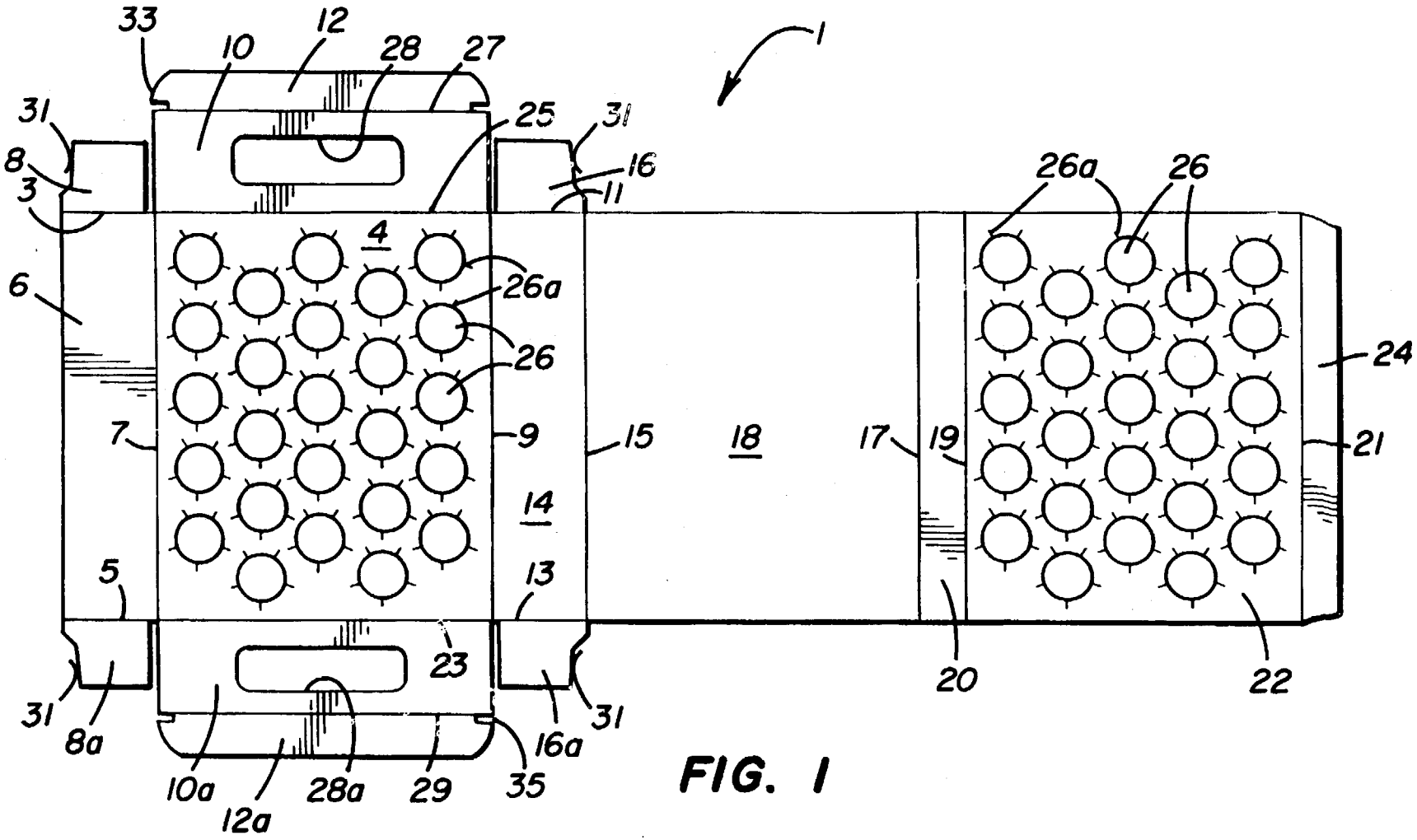
FIG. 1 is a plan view of a blank adapted to be folded to form an embodiment of tube rack.
Figure 3:
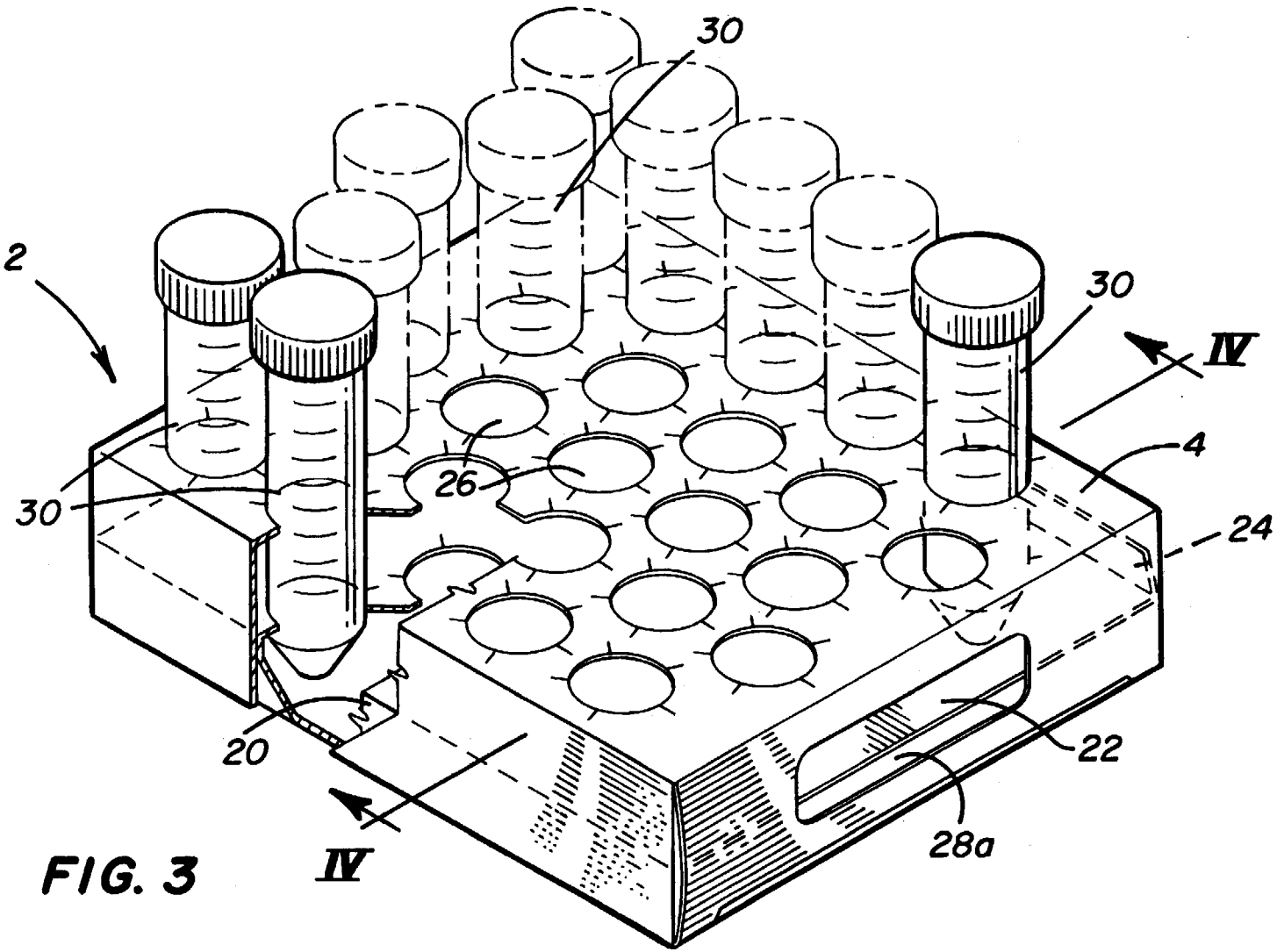
FIG. 3 is a perspective view with an embodiment of the rack fully assembled and holding specimen tubes, showing the viewing port and having a cut-away section showing the tubes being supported by the top and intermediate panels.

Referring now to the drawings in general and particularly to FIG. 1, there is shown an embodiment of the present invention, a blank 1 from which a rack 2 for holding tubes and the like is formed (shown generally in FIG. 3). The blank can be made from cardboard, paperboard or any material which can be used to form a sheet. Paperboard is a sheet material composed of laminated layers of paper. Any material can be used if it is flexible enough to be easily creased and folded over on itself without breaking and yet is still rigid under its own weight. For this embodiment of the invention, for a blank 1 to form a rack 2 to hold common test tubes, the best material is paperboard. Optionally, one or both sides of the paperboard can be further coated with a water-repellant material to protect the paperboard from moisture.

The blank 1 in FIG. 1 has a rectangularly shaped top panel 4 wherein a plurality of holes 26 are formed in alternating rows. Slits 26*a* have been cut in a radiating fashion from each hole to allow the arc of the hole to easily deform slightly when a tube 30 (see FIG. 3) or elongated object having a diameter of slightly larger than the hole itself, is inserted into that hole. This deformation allows the edge of the hole 26 to flexibly press on the inserted tube 30, thereby holding it securely within the hole.

Top panel 4 is hingedly attached on two parallel edges, by scorelines 25 and 23, a method well known in the art, to two rectangular flaps 10 and 10*a*. Flap 10 has a hole formed in the middle hereinafter called a view port 28 and flap 10*a* also has a view port 28*a*. View ports 28 and 28*a* allow one to see within the completed rack 2. These view ports are a convenience which enable the user to see the contents of clear tubes which have been inserted into the rack.

Flap 10 is further hingedly attached to a flange 12, by means of scoreline 27, on the side of flap 10 that is distal to the attached top panel; flap 10*a* is likewise hingedly attached to flange 12*a*, by means of scoreline 29, on the side of flap 10*a* that is distal to the attached top panel.

When forming the rack 2, flanges 12 and 12*a* are folded inwardly and inserted within the completed rack to both anchor the flaps and prevent the rack from collapsing. The flanges are generally rectangular in shape but are best bevelled inwardly at the ends, as shown at 33, to allow for easier insertion as the bevel 33 acts as a guide during insertion.

It should be noted that in this embodiment that scorelines 27 an 29 do not extend the complete length of the attachments of flange 12 to flap 10 and flange 12*a* to flap 10*a*. The ends of these junctures, as shown at 35, are not attached at all. These loose ends on the flanges 12 and 12*a* which, after the blank has been folded into a rack, (2 in FIG. 3), tend to entangle themselves with end sections 8 and 8*a* (described below), thereby reducing the possibility that the flanges and flaps will fall out after they have been inserted.

The top panel is hingedly attached on one of its remaining two edges, here by means of scoreline 7, to a rectangular first side section 6. The first side section is also hingedly attached to two rectangular end sections 8 and 8*a* at scorelines 3 and 5, both of which are normal to scoreline 7. Each end section has a notch 31 cut in them so that, when folded, they will more freely allow flanges 12 and 12*a* to pass over them during insertion into the completed rack 2. The end sections 8 and 8*a* are each connected to the first side section 6 only on one of their sides, at scorelines 3 and 5. Note that although the end sections 8 and 8*a*, as shown in the blank 1 in FIG. 1 are next to flaps 10 and 10*a*, neither is connected to a flap section.

The top panel is hingedly attached on its remaining edge, here by means of scoreline 9, to a rectangular second side section 14. The second side section 14 is also hingedly connected to two rectangular end sections 16 and 16*a* at scorelines and 13, which are normal to scoreline 9. Each end section has a notch 31 cut in them so that, when folded, they will more freely allow flanges 12 and 12*a* to pass over them during insertion into the completed rack.

The end sections 16 and 16*a* are each connected to the second side section 14 only on one of their sides, at scorelines 11 and 13. Note that although the end sections 16 and 16*a*, as shown in FIG. 1 are next to flaps 10 and 10*a*, neither is connected to a flap section.

The second side section is hingedly attached on its edge distal to scoreline 9, by means of scoreline 15, to a rectangular bottom panel 18, of substantially the same length and width as the top panel 4. When folded into the completed rack (2 in FIG. 3), the bottom panel 18 serves as the bottom or floor of the rack which the inserted tubes stand on.

The bottom panel 18 is hingedly attached by its edge distal to scoreline 15, by means of scoreline 17, to a rectangular first support 20. First support 20 has a height dimension of generally one half of the height of the assembled rack 2. In the completed rack 2, this support is glued to first side section 6 in the interior of the rack.

The first support 20 is hingedly attached on its edge distal to scoreline 17, by means of scoreline 19, to a rectangular intermediate panel 22. The intermediate panel 22 of the blank has a pattern of holes 26 formed which is symmetrical to that of the top panel 4, such that, when folded under and into a plane parallel to the top panel in the completed rack (2 in FIG. 3), the holes of the top panel and the intermediate panel are all in alignment. A tube or elongated object 30 inserted into aligned holes of the top and intermediate panels would thereby be held in an upright position.

In this embodiment the holes of the intermediate panel 22 also incorporate slits 26*a*, of the same kind as used in the top panel 4 holes 26, above.

The remaining piece of the blank 1 is the second support 24 which is hingedly attached on to the intermediate panel 22 on its edge that is distal to scoreline 19, by means of scoreline 21. Second support 24 has a height of less than the height of first support section 20. In the completed rack (2 in FIG. 3) the second support 24 is glued in the interior of the rack to second side section Together, first support section 20 and second support section 24 support intermediate panel 22.

Figure 2:
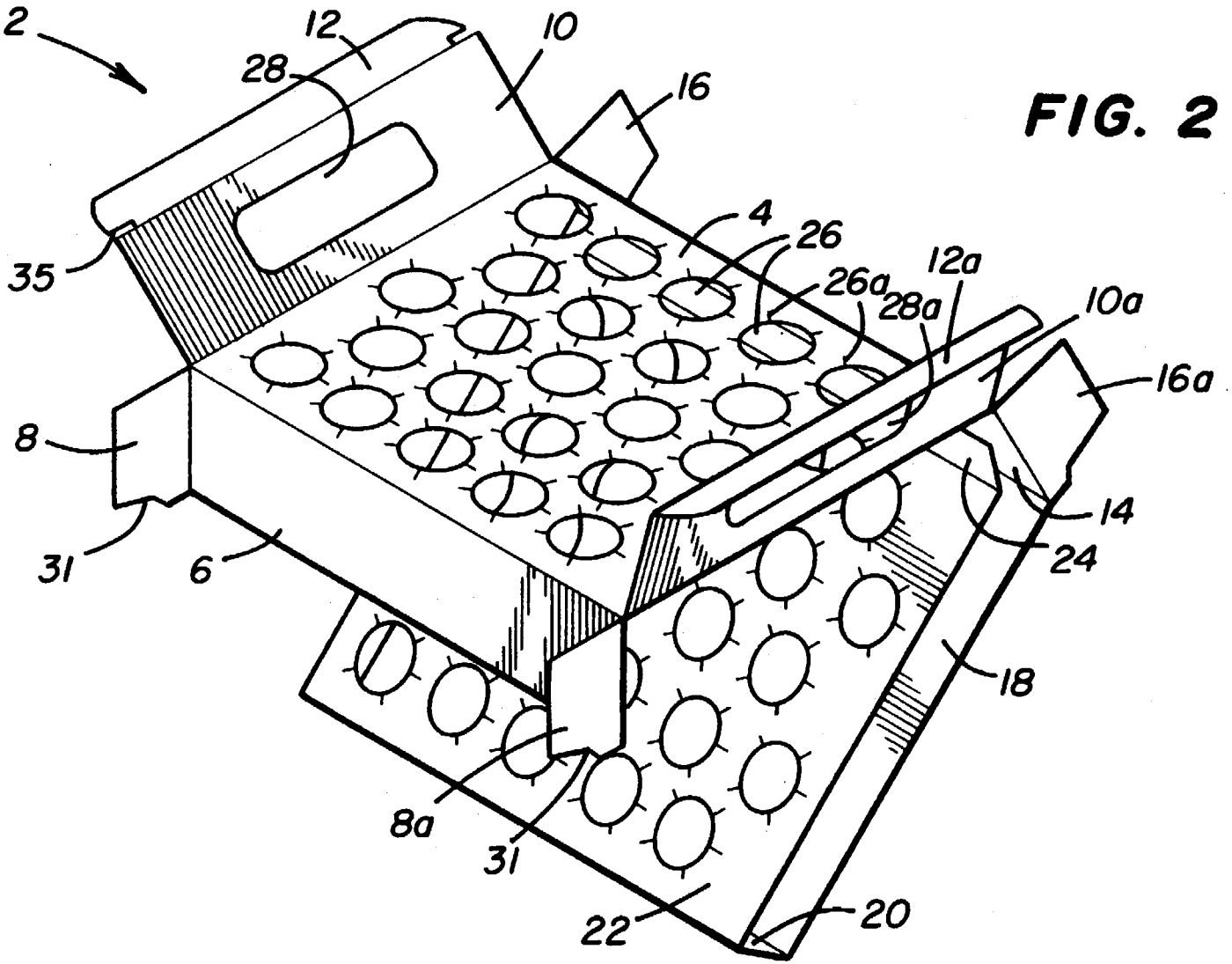
FIG. 2 is a perspective view showing an embodiment of the rack in a partially folded state.

Referring now to FIG. 2, a partially folded rack 2 made from the blank 1 is illustrated. Side sections 6 and 14 are folded to extend downwardly from top panel 4. Bottom panel 18 is then folded to a position underneath the top panel 4. First support 20 is folded to extend upwardly from the bottom panel and intermediate panel 22 is folded to extend to a position between the bottom and top panels. Second support section 24 can be folded either upwardly or downwardly, but if folded upwardly will allow the finished rack to collapse more easily.

Second support section 24 would next be glued to the inside of second side section 14. Then first side section 6 is folded down to contact first support section 20 and then glued together on the inside of that first side section. End sections 8 and 8*a* are bent towards each other, as are end sections 16 and 16*a*. Lastly, flaps 10 and 10*a* are folded to extend downwardly from top panel 4 and their respective flanges 12 and 12*a* are tucked into the rack, between the bottom panel 18 and the notches 31 on the end sections. To collapse the rack, the user need only pull out the flaps, there are no locking tabs to first disconnect.

In FIG. 2 flaps 10 and 10*a* and end sections 8 and 8*a* have been shown, for illustrative purposes, bent in the opposite direction from the correct direction for assembly of the rack 2.

Referring now to FIG. 3, the completed rack 2 is shown holding specimen tubes 30. FIG. 3 has a cut-away portion which shows how the tubes pass through top panel 4, then through intermediate panel 22 and are thereby held in an upright position. The intermediate panel 22 is supported by first support section 20 and second support section 24, both of which are shown glued to the inside of their respective side sections.

Figure 4:
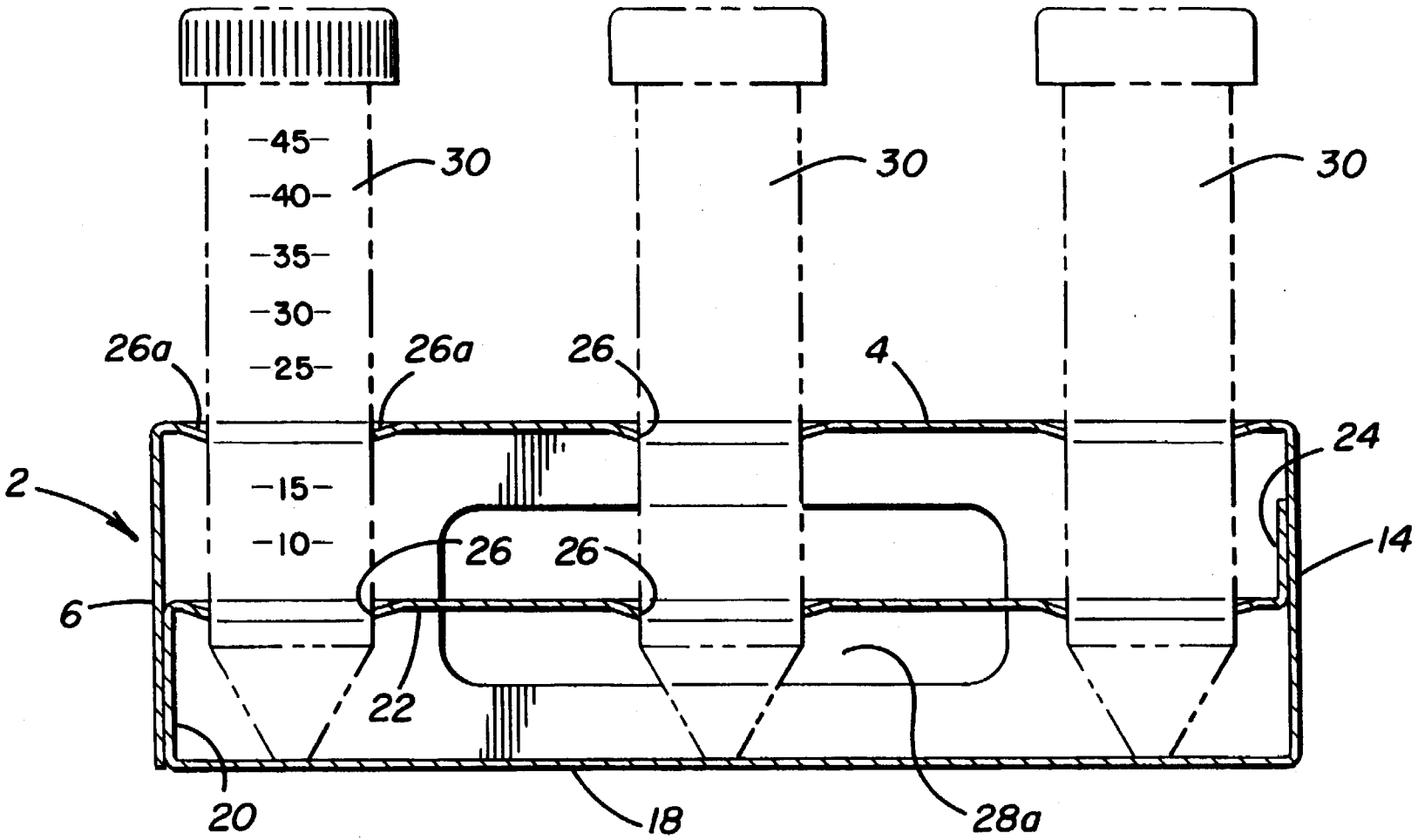
FIG. 4 is a sectional view, taken along line IV—IV of FIG. 3, showing the spiral-like folding of the sections of the blank in the completed rack, as well as the paper-to-paper bonds between the support sections and the side sections.

FIG. 4 is a sectional view of the completed rack, taken along line IV—IV of FIG. 3. Specimen tubes 30 pass through top panel 4, then through intermediate panel 22, coming to rest on bottom panel 18 and are thereby held in an upright position.

FIG. 4 shows the spiral-like folding pattern of the sections of the blank in the completed rack 2, as well as the paper-to-paper bonds between the support sections 20 and 24 and the side sections 6 and 14. Following the direction of the folding, first side section 6 joins the top panel 4 at a clockwise right angle; second side section 14 then joins the top panel 4 at a clockwise right angle; bottom panel 18 then joins the second side section 14 at a clockwise right angle to fold under the top panel 4; first support section 20 then joins the bottom panel 18 at a clockwise right angle, where it is glued to the inside of first side section 6; intermediate panel 22 then joins the first support section 20 at a clockwise right angle, positioning intermediate panel 22 in a plane parallel to both top and bottom panels; lastly, second support section 24 then joins intermediate panel 22, here shown with a counterclockwise bend, and second support section 24 is glued to the inside of second side section 14.

It should be noted in FIG. 4. that the relative distance of the intermediate panel 22 between the top panel 4 and bottom panel 18 is determined by the height of the first support section 20. The optimal position of the intermediate panel 22 is about equidistant between the top and bottom panels, as shown in FIG. 4, at 22. However, if the tip of the tube or elongated object 30 inserted into the two aligned holes comes to a tapered end, as does specimen tube 30 shown, the first support 20 can be heightened, to place intermediate panel 22 above the taper and closer to top panel 4. Alternatively, the holes 26 in the intermediate panel 22 can be sized smaller to receive the tapered portion of the tube.

Also shown in FIG. 4 is view port 28*a* and how it allows the user to see within the completed rack 2 and therefore the contents of the specimen tubes 30.

It should be understood that various changes can be made by those skilled in the art without departing from the essence of the invention as claimed.

What is claimed is:

1. A blank for forming a rack for holding tubes and the like in an upright position, comprising:

a) a rectangular top panel having a plurality of substantially round holes formed to receive an elongated object, wherein each of said round holes is adapted to be relatively smaller in diameter than the elongated object it is formed to receive, and wherein one or more of said holes formed to receive the elongated object has one dr more slits, radiating from the edge of that hole, thereby allowing said holes to easily partially deform when the elongated object of greater size than that hole is inserted and holding the elongated object with friction, and further wherein said plurality of holes formed to receive said elongated objects are arranged in a pattern of staggered rows, thereby allowing the rows to be placed more closely to each other;

b) a rectangular first side section hingedly attached to one edge of said top panel, having first and second end sections, the edges of said first side section connecting to said first and second end sections being normal to the edge of attachment of said first side section to said top panel;

c) two rectangular flaps, one hingedly attached to an edge of the top panel normal to said first side section, the other hingedly attached to the edge distal the attachment of said top panel to the first flap, each flap further having a flange section hingedly attached to the edge distal to the edge of attachment of said top panel, and wherein a hole is formed in one or both of said flaps, thereby forming a view port;

d) a rectangular second side section hingedly attached to the edge of said top panel distal to the edge where the top panel attaches to said first side section, having first and second end sections, the edges of said second side section connecting to said end sections being normal to the edge of attachment of said second side section to said top panel;

e) a rectangular bottom panel, hingedly attached to said second side section on the edge distal to the attachment of said top panel to said second side section;

f) a rectangular first support section hingedly attached to said bottom panel on the edge distal to the attachment of said bottom panel to said second side section;

g) a rectangular intermediate panel hingedly attached to said first support section on the edge distal to the attachment of said first support section to said bottom panel, having a plurality of holes formed to receive an elongated object and in such a pattern that the holes formed will align with the holes formed in said top panel when the blank is assembled into a rack, and wherein each of said holes is adapted to be relatively smaller in diameter than the elongated object it is formed to receive, and wherein one or more of said holes formed to receive the elongated object has one or more slits radiating from the edge of that hole, thereby allowing said holes to easily partially deform when the elongated object of greater size than that hole is inserted and holding the elongated object with friction;

h) a rectangular second support section hingedly attached to said intermediate panel on the edge distal to the attachment of said second support section to said intermediate panel;

wherein said first and second end sections on said rectangular first side and said second side are fixable respectively to said two rectangular flaps, said first support is fixable to said first side section proximate said bottom panel, and said second support is fixable to said second side section proximate said top panel, wherein said flanges are fixable to said bottom panel, and whereby said rack permits viewing above and below said intermediate panel.

2. A blank for forming a rack for holding tubes and the like upright, comprising:

a) a rectangular top panel having parallel first and second edges, and third and fourth edges normal to the first and second edges, and further having a plurality of substantially round holes formed to receive elongated objects, wherein, each of said round holes is adapted to be relatively smaller in diameter than the elongated object it is formed to receive, and wherein one or more of said holes formed to receive an elongated object further has one or more slits radiating from the edge of that hole, thereby allowing said holes to easily partially deform when an elongated object is inserted and holding the elongated object with friction, and further wherein said plurality of holes are arranged in a pattern of staggered rows, thereby allowing the rows of holes to be placed more closely to one another;

b) a rectangular first side section having first, second, third and fourth edges complementary to the edges of said top panel, wherein the first side section is hingedly attached by its second edge to the first edge of said top panel, and further wherein said first side section is further hingedly attached by its third edge to a first end section and is hingedly attached by its fourth edge to a second end section;

c) two rectangular flaps, the first hingedly attached to the third edge of said top panel, the second hingedly attached to the fourth edge of said top panel, each flap further having a flange section hingedly attached to the edge of the flap distal to the edge attached to top panel, and wherein a hole is formed in one or both of said flaps, thereby forming a viewing port;

d) a rectangular second side section having first, second, third and fourth edges complementary to the edges of said top panel, wherein the second side section is hingedly attached by its first edge to the second edge of said top panel, and further wherein said second side section is further hingedly attached by its third edge to a first end section and is hingedly attached by its fourth edge to a second end section;

e) a rectangular bottom panel of substantially the same dimensions of said top panel, having first, second, third and fourth edges complementary to the edges of said top panel, hingedly attached on its first edge to the second edge of said second side section;

f) a rectangular first support section, having first, second, third and fourth edges complementary to the edges of said top panel, hingedly attached on its first edge to the second edge of said bottom panel;

g) a rectangular intermediate panel, having first, second, third and fourth edges complementary to the edges of said top panel, further having a plurality of holes in the same pattern as said top panel and hingedly attached on its first edge to the second edge of said first support section, whereby the holes formed align with the holes formed in said top panel when the blank is assembled into a rack, and wherein each of said holes is adapted to be relatively smaller in diameter than the elongated object it is formed to receive, and wherein one or more of said holes formed to receive the elongated object has one or more slits radiating from the edge of that hole, thereby allowing said holes to easily partially deform when the elongated object of greater size than that hole is inserted and holding the elongated object with friction;

h) a rectangular second support section having first, second, third and fourth edges complementary to the edges of said top panel, hingedly attached to the second side of said intermediate panel;

wherein said first and second end sections on said rectangular first side and said second side are fixable respectively to said two rectangular flaps, said first support is fixable to said first side section proximate said bottom panel, and said second support is fixable to said second side section proximate said top panel, wherein said flanges are fixable to said bottom panel, and whereby said rack permits viewing above and below said intermediate panel.

3. A rack for holding tubes and the like upright, comprising:

a) a rectangular top panel having a plurality of substantially round holes sized to receive a given elongated object, wherein said plurality of holes formed are arranged in a pattern of alternatingly staggered rows of holes, thereby allowing said rows of holes to be placed more closely to one another, and further wherein each of said holes is adapted to be relatively smaller in diameter than the elongated object it is formed to receive, and wherein one or more of said holes formed for receiving elongated objects has one or more slits radiating from the edge of that hole, thereby allowing said hole to easily deform when a tube of larger diameter than that hole is inserted and holding the tube with friction, and wherein said rectangular top panel is hingedly attached on one side to a first side section extending downwardly, said first side section further having two hingedly attached end sections folded inwardly and under said top panel, one at each edge of said first side section that is normal to the edge of attachment of said first side section to said top panel;

b) a second side section, hingedly attached to said top panel distal from the edge of attachment of said top panel to said first side section and extending downwardly, said second side section further having two hingedly attached end sections folded inwardly and under said top panel, one at either edge of said second side section that is normal to said top panel;

c) a rectangular bottom panel of substantially the same size as said top panel, hingedly attached to said second side section and folded to extend under said top panel;

d) a first support section hingedly attached to said bottom panel at the edge distal to the connection between said bottom panel and said second side section, extending upwardly and fixedly attached to the inner side of said first side section proximate said bottom panel;

e) an intermediate panel of substantially the same dimensions as said top panel, hingedly attached to said first support section and folded inwardly to between said top panel and said bottom panel, having a plurality of substantially round holes in a pattern of holes identical to and aligned with that of said top panel, and wherein each of said holes is adapted to be relatively smaller in diameter than the elongated object it is formed to receive, and wherein one or more of said holes formed to receive the elongated object has one or more slits radiating from the edge of that hole, thereby allowing said holes to easily partially deform when the elongated object of greater size than that hole is inserted and holding the elongated object with friction, thereby allowing an elongated object placed in a hole in said top panel and continuing through the complementary hole in said intermediate panel to be held upright;

f) a second support section, hingedly attached at a right angle to said intermediate panel on the edge distal the connection between said intermediate panel and said first support section and fixedly attached to the inner side of said second side proximate said top panel section;

g) means, for attaching said support sections to the inner side of said side sections;

h) a first flap and a second flap, each further having a hingedly attached flange, hingedly attached to said top panel distal each other and normal to said first and second side sections, extending downwardly and further having the flanges extending inwardly to occupy the space between said end sections said bottom panel, and wherein a hole is formed in one or both of said flaps, thereby forming a view port, and whereby said blank is assembled into a rack and said view port permits viewing above and below said intermediate panel.

* * * * *